US009201367B2

(12) United States Patent
Miyake

(10) Patent No.: US 9,201,367 B2
(45) Date of Patent: Dec. 1, 2015

(54) IMAGE FORMING APPARATUS

(71) Applicant: CANON KABUSHIKI KAISHA, Tokyo (JP)

(72) Inventor: Kazunori Miyake, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/479,174

(22) Filed: Sep. 5, 2014

(65) Prior Publication Data

US 2015/0093124 A1 Apr. 2, 2015

(30) Foreign Application Priority Data

Sep. 27, 2013 (JP) ..... 2013-201879

(51) Int. Cl.

| | |
|---|---|
| ***G03G 15/00*** | (2006.01) |
| ***B41J 29/38*** | (2006.01) |
| ***G03G 15/20*** | (2006.01) |
| ***G03G 21/16*** | (2006.01) |

(52) U.S. Cl.

CPC ..... *G03G 15/2071* (2013.01); *G03G 15/70* (2013.01); *G03G 21/1633* (2013.01); *G03G 21/1638* (2013.01); *G03G 2215/00544* (2013.01)

(58) Field of Classification Search

CPC ..... G03G 15/2067; G03G 15/2035; G03G 15/657; G03G 2215/00413; G03G 2221/1639; G03G 15/2071

See application file for complete search history.

(56) References Cited

U.S. PATENT DOCUMENTS

2014/0291924 A1* 10/2014 Isohara ..... 271/228

FOREIGN PATENT DOCUMENTS

| | | | | |
|---|---|---|---|---|
| JP | 02123051 A | * | 5/1990 | ..... B65H 5/06 |
| JP | 02204238 A | * | 8/1990 | ..... B65H 5/06 |
| JP | 2006235421 A | * | 9/2006 | ..... G03G 15/16 |
| JP | 2012-230245 A | | 11/2012 | |
| JP | 2013164610 A | * | 8/2013 | ..... G03G 15/20 |

OTHER PUBLICATIONS

U.S. Appl. No. 14/479,182, filed Sep. 5, 2014 by Kazunori Miyake.

* cited by examiner

*Primary Examiner* — Daniel J Colilla
*Assistant Examiner* — Ruben Parco, Jr.
(74) *Attorney, Agent, or Firm* — Fitzpatrick, Cella, Harper & Scinto

(57) ABSTRACT

An image forming apparatus comprising a conveyance path of recording material comprises a door, when opened, the inside of the apparatus is exposed, and an interlock circuit which detects opening/closing state of the door. The detection unit of the door is arranged on the conveyance path. At the arranged position, the image forming apparatus comprises a registration sensor for detecting presence and absence of the recording material and delivery sensor. The CPU controls pressure to the recording material S passing the fixing nip portion formed by a pair of rollers arranged on the conveyance path. Also, the CPU decides whether the recording material exists at the fixing nip portion based on the respective detection result from the registration sensor and the delivery sensor.

11 Claims, 4 Drawing Sheets

IMAGE FORMING APPARATUS

BACKGROUND OF THE INVENTION

1. Field of the Invention

The present invention relates to a technology to control pressurized state and pressure releasing state of a nip portion when a door is opened during an image forming operation and an interlock circuit is operated in an image forming apparatus.

2. Description of the Related Art

In Some business machines including an image forming apparatus, e.g., a printer and a multifunction peripheral, an interlock circuit to protect user's safety is installed. In particular, power supplied to a driving device such as motor is interrupted depending on a state of door switch (interlock switch). The door switch is arranged to link to an opening and closing of a front door or to an opening and closing of a right door of the machine. It means that if the front door etc., is opened, even when it is in a state that the power is supplied to the machine (powered on state), it is controlled such that driving voltage is not applied. This enables to prevent occurrence of incident such as electrocution of a user.

For example, as an interlock circuit installed on such a machine, Japanese Patent Application Laid-open No. 2012-230245 discloses an interlock circuit employing a relay for interrupting power supply line of the driving circuit to thereby interrupt the driving circuit of the relay by the interlock switch.

Also, conventionally, a fixing unit is provided on a general image forming apparatus. The fixing unit is a unit for fixing toner image on a recording material. The fixing unit is configured to melt and fix toner on the recording material by giving predetermined pressure and predetermined heat to a recording paper.

In an image forming apparatus which interrupts power supply of the driving circuit in conjunction with door opening, when the user opens door of the machine while the image forming apparatus is in the image forming operation, power supply of the driving circuit is interrupted by the interlock circuit. This results in an occurrence of a phenomenon in which the recording material is jammed in a conveyance path of the recording material (hereinafter, the phenomenon is referred to as JAM. Also, the recording material remaining in the conveyance path is referred to as a JAM paper).

Also, at this time, as to a driving circuit for performing pressure releasing operation to the nip portion between a pressure roller and a fixing roller in the fixing unit, its power supply is interrupted. Therefore, it becomes impossible to perform pressure release operation, which makes it difficult to remove JAM paper which is stopped at the nip portion.

Also, a fixing system which is quickly raised is known in the art. In the fixing system, a fixing film is used as the fixing roller to heat the recording paper. In such a system, when JAM occurs, the user may remove JAM paper (the process of removing the JAM paper is hereinafter referred to as JAM process).

At this time, when the recording material is removed with the recording paper is pressurized at the nip portion, the apparatus and the recording material may be damaged. Particularly, the fixing film in the fixing unit may be damaged or the JAM paper may be torn. This is a problem

SUMMARY OF THE INVENTION

According to an aspect of the present disclosure, an image forming apparatus includes a conveyance path of a recording material provided in an inside of the image forming apparatus; a door which is provided such that the inside of the apparatus including the conveyance path is exposed, a door opening/closing detection unit configured to detect opening or closing of the door; a pair of rollers which forms a nip portion for holding and conveying the recording material on the conveyance path; a decision unit configured to decide whether or not the recording material exists at the nip portion; and a control unit configured to control a pressurized state and a pressure releasing state of the nip portion of the pair of rollers. The control unit is configured to control to release pressure at the nip portion in a case where the door opening is detected and the recording material exists at the nip portion.

Further features of the present invention will become apparent from the following description of exemplary embodiments (with reference to the attached drawings).

DESCRIPTION OF THE EMBODIMENTS

Now, embodiments of the present disclosure are described. With reference to the drawings, an electrophotographic image forming apparatus is explained as an example of the image forming apparatus.

<Configuration of Image Forming Apparatus>

Figure 1A:
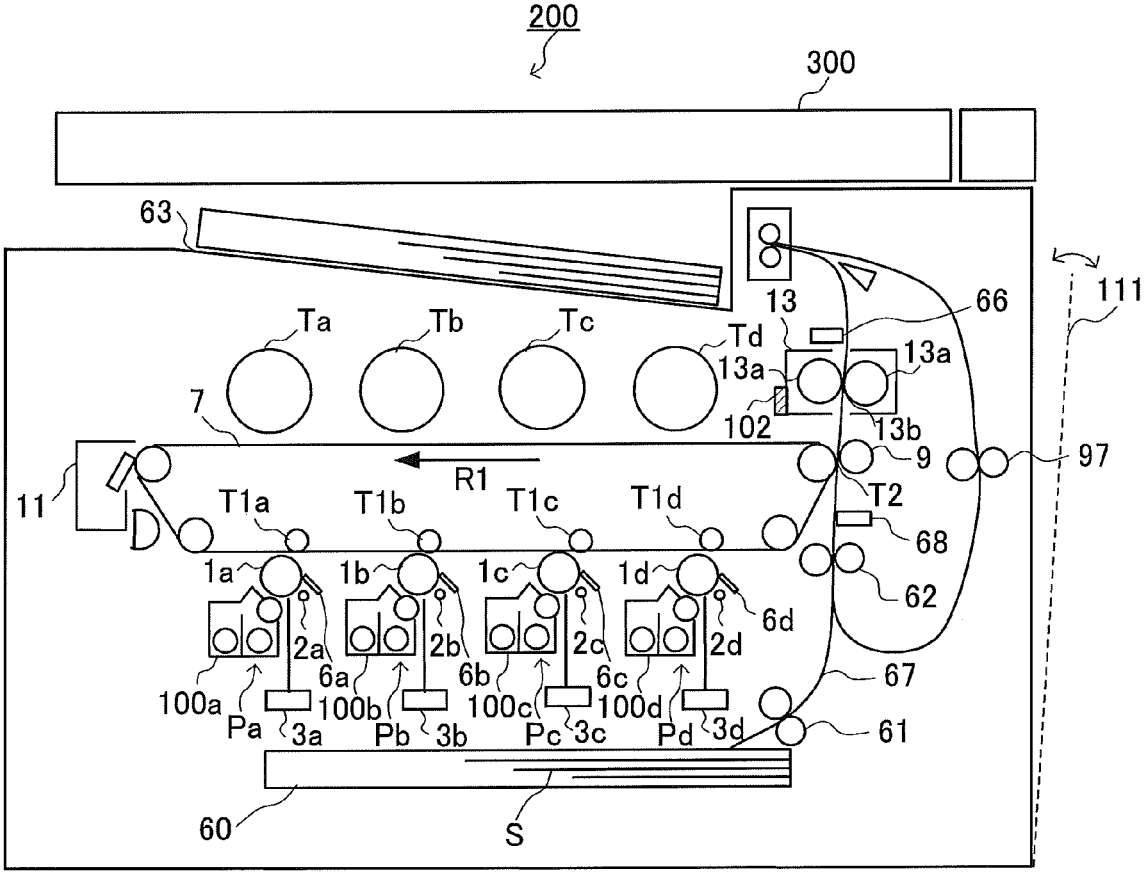
FIGS. 1A and 1B are schematic diagrams of an image forming apparatus according to the present embodiment.
Figure 1B:
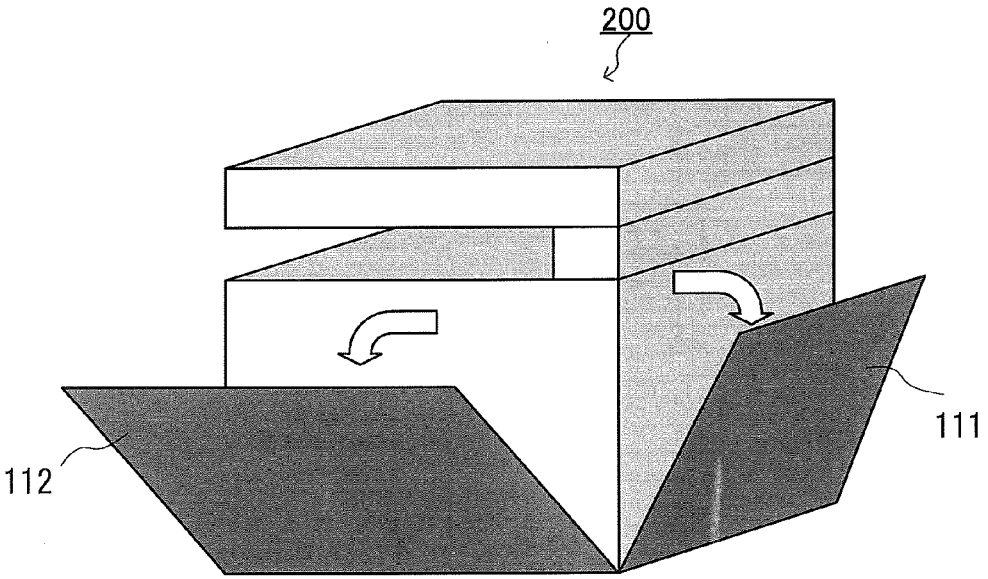

FIGS. 1A and 1B are diagrams illustrating an example of a configuration of the image forming apparatus according to the present embodiment.

FIG. 1A is a schematic vertical sectional view of the image forming apparatus 200. FIG. 1B is a perspective view illustrating door configuration of the image forming apparatus 200.

The image forming apparatus 200 illustrated in FIG. 1A comprises a scanner 300 for reading a document to obtain image information. The image forming apparatus 200 includes image forming units Pa, Pb, Pc, and Pd respectively corresponding to four colors (yellow (y), magenta (M), cyan (C), black (BK)). The image forming units Pa, Pb, Pc, and Pd are arranged along an intermediate transfer belt 7. It means that the image forming apparatus 200 is an intermediate transfer tandem-type image forming apparatus. Recently, the intermediate transfer tandem system is gaining popularity as it can enhance productivity and can handle various media conveyance. Note that the number of colors is not limited to the adaptable four colors. The number of colors may be only one such as black (BK) corresponding to monochrome. Also, the order of the colors is not limited to this. Each component of the image forming apparatus 200 is controlled by CPU 205 (FIGS. 2A and 2B) which will be described later. Description is made with regard to an image forming process by the image forming apparatus 200.

<Recording Material Conveying Process>

A recording material S illustrated in FIG. 1A is a sheet on which an image is formed. The recording material S is stored in a recording material storage 60. The recording material S is fed from the recording material storage 60 by a sheet feed roller pair 61. The recording material S is then conveyed to a registration roller pair 62 via a conveyance path 67. In the registration roller pair 62, skew correction is made to the recording material S. Also, timing to convey the recording material S is adjusted. Thereafter, the recording material S is sent to a secondary transfer unit T2.

The secondary transfer unit T2 is a transfer nip portion formed by an opposing secondary transfer inner roller 8 and a secondary transfer outer roller 9. By an application of predetermined pressure and electrostatic load bias, the secondary transfer unit T2 transfers toner images, which will be described later, on the recording material S.

<Image Formation Process>

The image forming unit Pa in FIG. 1A is mainly comprised of a photosensitive member 1*a*, a charging device 2*a*, an exposure device 3*a*, a primary transfer device 4*a*, a photosensitive cleaner 6*a*, and a developing device 100*a*. Also, the image forming unit Pb is mainly comprised of a photosensitive member 1*b*, a charging device 2*b*, an exposure device 3*b*, a primary transfer device 4*b*, a photosensitive cleaner 6*b*, and a developing device 100*a*. The image forming unit Pc is mainly comprised of a photosensitive member 1*c*, a charging device 2*c*, an exposure device 3*c*, a primary transfer device 4*c*, a photosensitive cleaner 6*c*, and a developing device 100*c*. The image forming unit Pd is mainly comprised of a photosensitive member 1*d*, a charging device 2*d*, an exposure device 3*d*, a primary transfer device 4*d*, a photosensitive cleaner 6*d*, and a developing device 100*d*.

Description will be made, by exemplifying the image forming unit Pa, with regard to the image forming process which is synchronously performed with a conveyance process, thorough which, the recording material S is conveyed to the secondary transfer unit T2.

The surface of the photosensitive member 1*a* of the image forming unit Pa is uniformly charged by the charging device 2*a* in advance and is rotationally driven. The exposure device 3*a* forms, based on a signal of image information read and obtained by the scanner 300, electrostatic latent images on the surface of the photosensitive drum 1*a*.

The development device 100*a* develops the electrostatic latent images formed on the photosensitive drum 1*a* as a toner image. Thereafter, a predetermined pressure and an electrostatic load bias are applied to the toner image by a primary transfer device T1*a*. The toner image is then transferred to the intermediate transfer belt 7.

The toner which is not transferred and remained on the photosensitive member 1*a* is recovered by the photosensitive cleaner 6*a*. The image forming process as above is also executed in each of the image forming units Pb, Pc, and Pd.

The development devices 100*a*, 100*b*, 100*c*, and 100*d* store toners of corresponding colors. The toner includes two-component toner which mixes nonmagnetic toner and magnetic carrier in advance or one-component toner which includes one of magnetic toner or nonmagnetic toner. In the image forming apparatus 200 of the present embodiment, the two-component toner is used. The description is made accordingly.

When toner amount for the development devices 100*a*, 100*b*, 100*c* and 100*d* is decreased, the toner is supplied through a toner supply device (not shown) which is mounted on each toner storage part (hereinafter referred to as toner bottle) Ta, Tb, Tc, and Td. Also, when toner amount in the toner supply device (not shown) is decreased, the toner is supplied from the corresponding toner bottle Ta, Tb, Tc, and Td.

The intermediate transfer belt 7 in FIG. 1A is mounted on an intermediate transfer belt frame (not shown). The intermediate transfer belt 7 is conveyed and driven in the direction of R1 in FIG. 1.

In the image forming process of each color, in which each color is processed in parallel by the image forming units Pa, Pb, Pc, and Pd, each color is transferred on the toner image of the color which has been primarily transferred onto the intermediate transfer belt 7. As a result, full color toner image is formed on the intermediate transfer belt 7. Then, the toner image is transferred to the recording material S in the secondary transfer part T2. Note that the toner not transferred to the recording material S and remained on the intermediate transfer belt 7 is recovered by the transfer cleaner device 11.

<Process after Secondary Transfer>

After the secondary transfer is performed in the secondary transfer part T2, the recording material S is conveyed to a fixing unit 13. The fixing unit 13 is mainly comprised of a pair of rollers (fixing roller 13*a*), fixing nip portion 13*b*, and heater (not shown) which will be a heat source. The pair of rollers is opposingly arranged. The fixing nip portion 13*b* holds and conveys the recording material S formed by the fixing roller 13*a*. At least one roller of the pair of fixing rollers 13*a* is connected such that driving power from a driving mechanism (not shown), for example, fixing motor 204, which will be described later is transmitted. Note that, the fixing motor 204 is configured such that it can rotate in a normal direction (first direction) and in a reverse direction (second direction). The detail thereof will be described later.

The fixing unit 13 gives predetermined pressure and predetermined amount of heat to the recording material S passing through the fixing nip portion 13*b*. Then, the fixing unit melts and fixes the toner images on the recording material S. In this way, the toner on the recording material is fixed on the recording material by pressure and heat. Thereafter, the recording material S having the images fixed thereon is delivered to the delivery tray 63. Alternatively, in a case where images are formed on both sides of the recording material S, the recording material S is conveyed to a reverse conveyance roller 97.

Note that a pair of the fixing rollers 13*a* conveys the recording material S in a conveying direction of the recording material while the recording material S is being pressurized in a case where the fixing motor 204 is rotated in the normal direction. Also, description is made on an assumption that, in a case where the fixing motor 204 is rotated in the reverse direction, a pair of the fixing rollers 13*a* is separated.

<Door Configuration>

Next, a configuration of door covering sides of the image forming apparatus 200 is described. FIG. 1B is a schematic perspective view of an example of a door configuration of the image forming apparatus 200. The image forming apparatus 200 comprises two door units. One is a front door unit 112 mounted on a front side when viewed from a front side of the apparatus shown in FIG. 1A. The other is a right door unit 111 mounted on a right side when viewed from the front side of the apparatus shown in FIG. 1A. The front door unit 112 is a door which is opened and closed by the user when each toner bottle (Ta to Td), a recovery toner box and the like are exchanged by the user. The right door unit 111 is a door which is opened and closed by the user when, for example, JAM processing, exchanging the fixing unit 13, and exchanging the intermediate transfer belt 7 of the image forming apparatus are performed by the user. As mentioned above, when each door is opened, the inside of the apparatus is exposed. This allows the user to access an inside of the image forming apparatus 200 including a conveyance path.

Note that, when the right door unit 111 is opened, a part of the fixing unit 13 as mentioned above is exposed, which enables to insert and remove the fixing unit 13 into and from the image forming apparatus 200. Note that a heater arranged in the fixing unit 13, a thermistor for keeping temperature of the heater in an optimum state, and the like are electrically connected to the image forming apparatus 200 via a drawer connector.

<Control System>

Figure 2A:
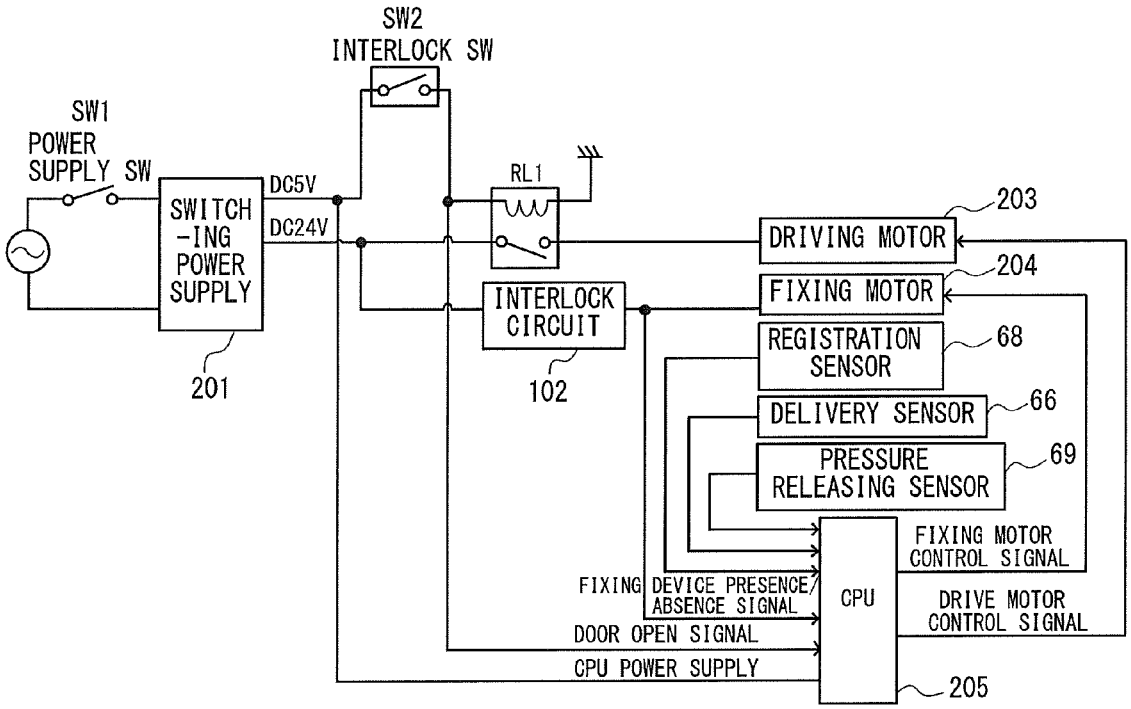
FIGS. 2A and 2B are diagrams exemplifying a control system of the image forming apparatus.
Figure 2B:
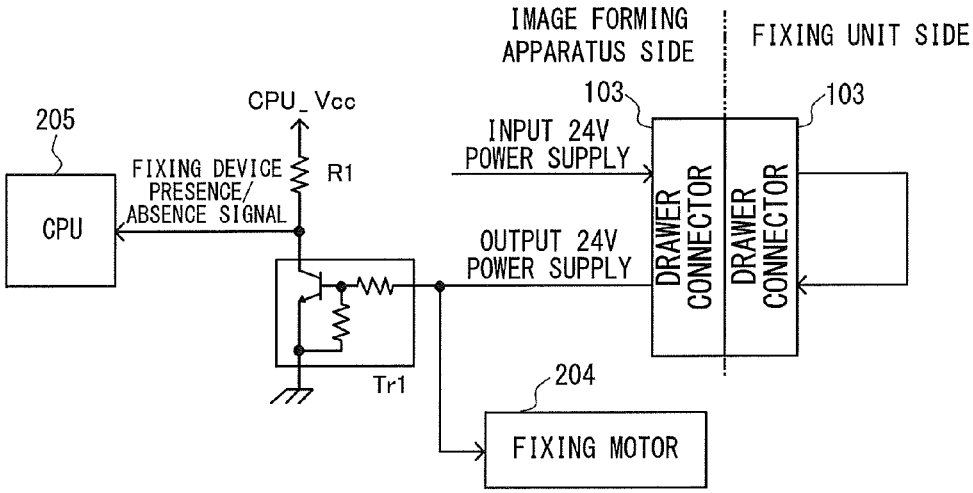

FIGS. 2A and 2B are block diagrams for explaining a control system of the image forming apparatus 200. FIG. 2A is a diagram for explaining an entire control system of the image forming apparatus 200. FIG. 2B is a diagram for explaining the interlock circuit 102 in FIG. 2A in detail.

A switching power supply 201 as shown in FIG. 2A generates DC5 [V] output power and DC24 [V] output power from AC input via a main switch SW1 of the image forming apparatus. The generated DC5 [V] power is supplied to CPU 205 and an interlock switch SW2. The CPU 205 is mounted on a control substrate (not shown) via power line. The interlock switch SW2 is opened and closed by the front door unit 112 or the right door unit 111. The interlock switch SW2 outputs door open signal to the CPU 205 when the door is opened. Also, it outputs door close signal to the CPU 205 when the door is closed. In this way, the interlock switch SW2 works as a door opening/closing detection unit.

Note that, description has been made with regard to a case where the power of DC5 [V] is supplied to the CPU 205, however, the power may be converted to DC3.3 [V] using a regulator and the like. The, the converted power may be supplied to the CPU 205. The power line for DC5 [V] after passing the interlock switch SW2 is connected to a coil power supply of a relay RL 1. Therefore, when the interlock switch SW2 is turned off, a contact of the relay RL 1 is opened, which stops power supply to a driving motor 203, which will be described later. Also, the power line for DC5 [V] after passing the interlock switch SW2 is connected such that the CPU 205 can detect ON/OFF of the DC5 [V] power.

A delivery sensor 66 and a registration sensor 68 as shown in FIG. 2A are arranged on a conveyance path of the recording material S. The sensors control conveyance timing, image formation timing and the like of the recording material S. The registration sensor 68 is a first sensor for detecting presence or absence of the sheet material S and is arranged on an upstream side of the secondary transfer part T2. The delivery sensor 66 is a second sensor for detecting presence or absence of the sheet material S, which is arranged on a downstream side of the fixing unit 13. A pressure releasing sensor 69 is configured to output "ON" signal when the fixing nip portion 13*b* is in a pressurized state. The pressure releasing sensor 69 is configured to output "OFF" signal when the fixing nip portion 13*b* is in a separating state.

The driving motor 203 conveys and drives the intermediate transfer belt 7 in accordance with content of drive motor control signal received from the CPU 205. As mentioned, when the interlock switch SW2 is turned off, power supply to the drive motor 203 is stopped.

The fixing motor 204, controlled by the CPU 205, is rotated in a rotation direction (normal rotation or reverse rotation) and rotation speed in accordance with content of fixing motor control signal received from the CPU 205. Also, as mentioned, when the fixing motor 204 is normally rotated, the fixing roller 13*a* is rotated so that the recording material S is conveyed. Also, when the fixing motor 204 is rotated in reverse direction, pressure applied to the fixing nip portion 13*b* is released. Then, the fixing roller 13*a* is separated.

As shown in FIG. 2B, the interlock circuit 102 is comprised of a drawer connector 103 which interconnects power supply and signal line between the image forming apparatus 200 side and the fixing unit 13 side. The drawer connector 103 forms the interlock circuit 102 by looping back the power line for the DC24 [V] in the fixing unit 13. The DC24 [V] power which is looped back via the drawer connector 103 is supplied to the fixing motor 204. Also, it is input to a base of the transistor Tr1. Then, the DC24 [V] power is input to the CPU 205 via resistance R1 as fixing device presence/absence signal which represents whether the fixing unit 13 is mounted or not. It means that removal of the fixing unit 13 from the image forming apparatus 200 enables to surely turn off the power supplied to the fixing motor 204. Note that the state of the interlock switch SW2 is independent of the power supply to the fixing motor 204. It means that even when the interlock switch SW is turned off, the power supply to the fixing motor 204 is not interrupted.

Figure 3A:
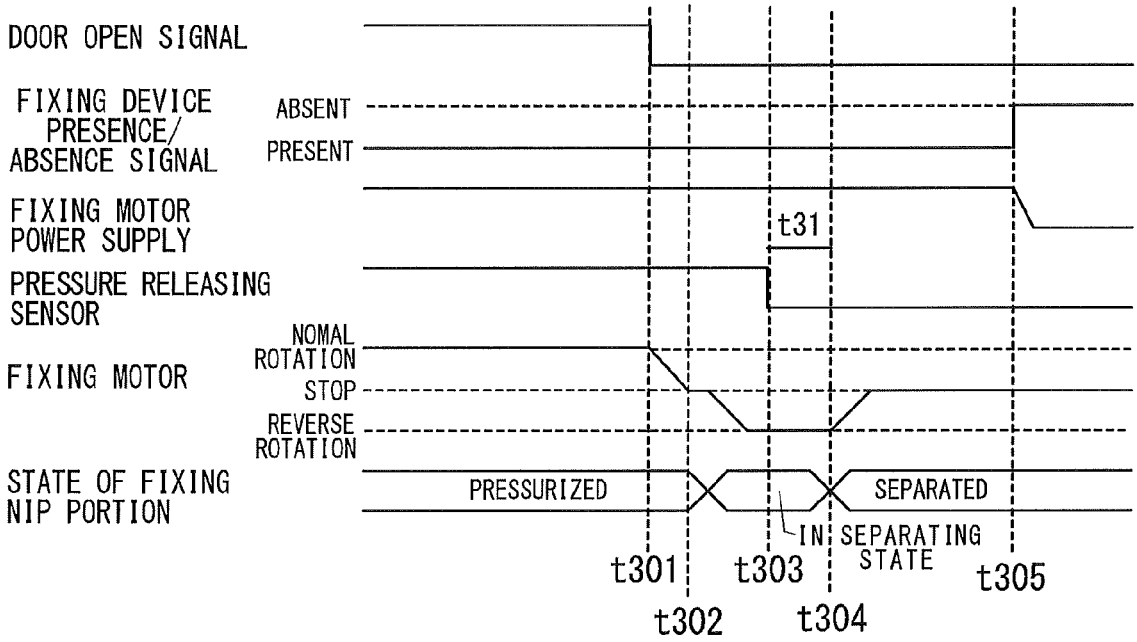
FIGS. 3A and 3B are timing charts when opening and closing door of the image forming apparatus according to the present embodiment.
Figure 3B:
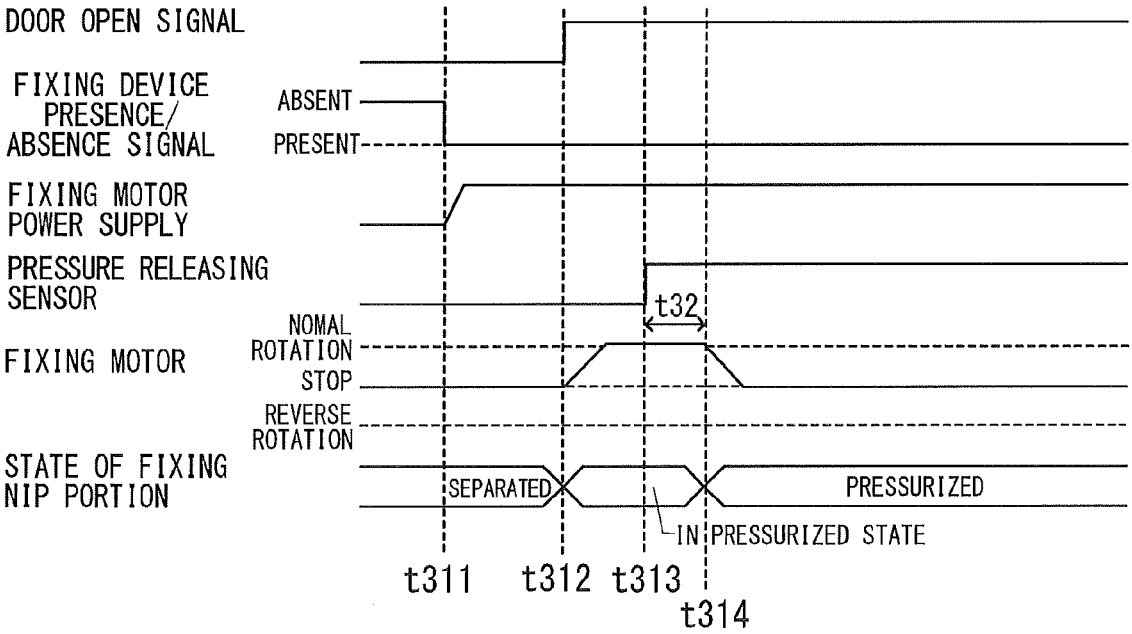
Figure 4A:
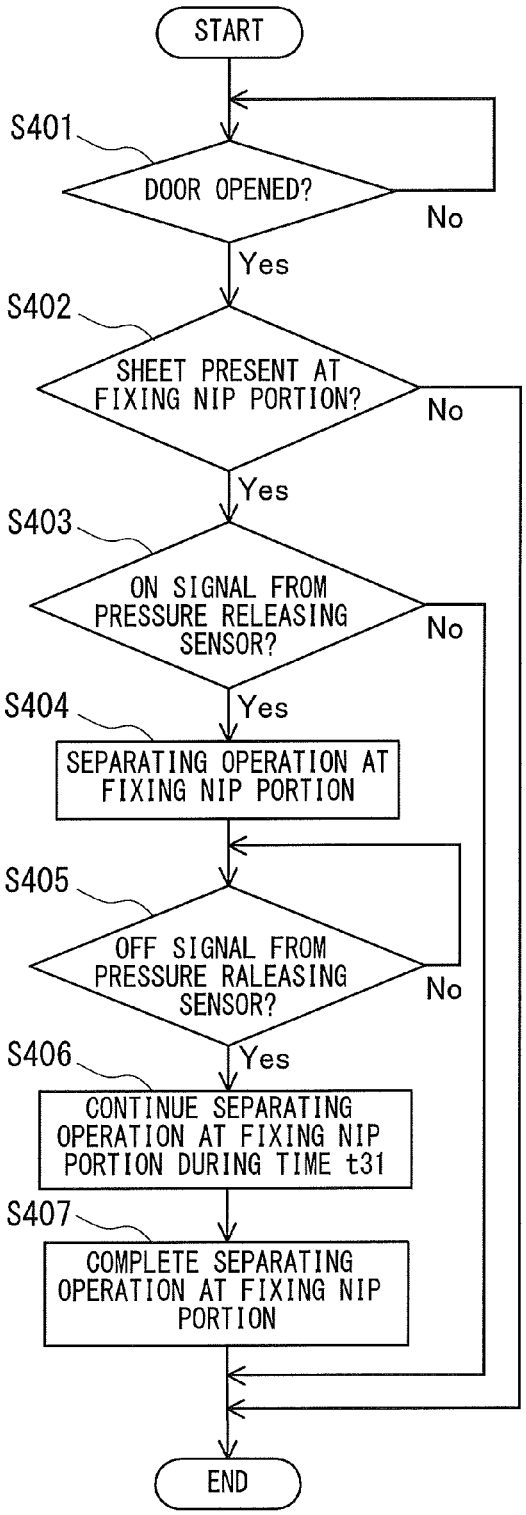
FIGS. 4A and 4B are flowcharts illustrating an example of control procedure when opening and closing door of the image forming apparatus according to the present embodiment.
Figure 4B:
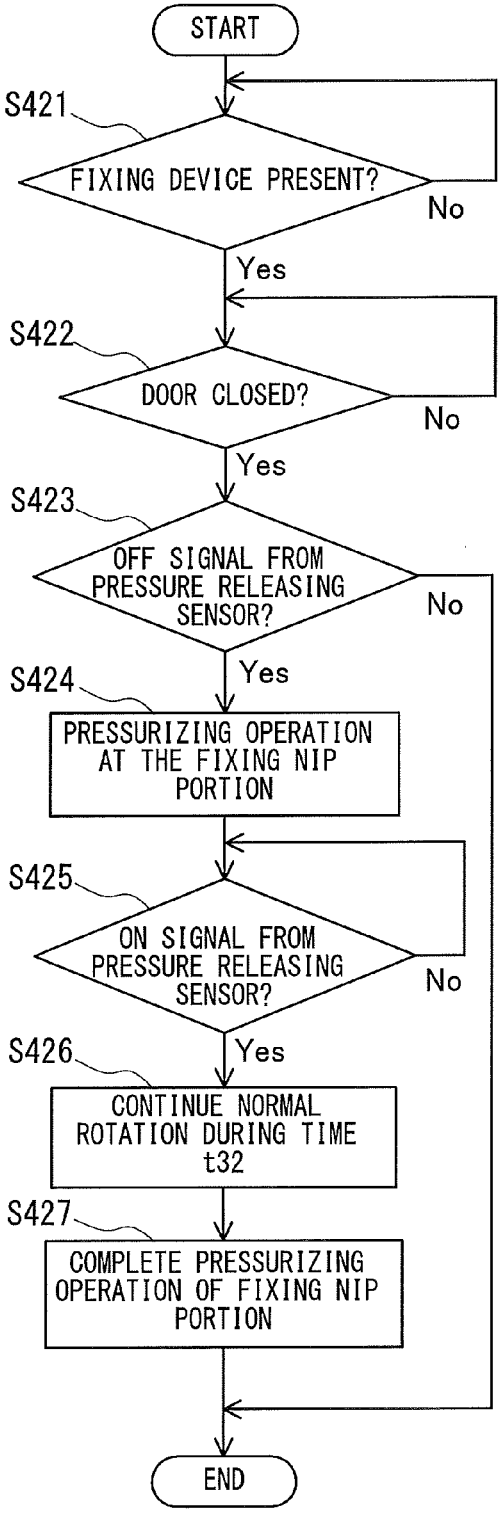

FIGS. 3A and 3B are timing charts when the door of the image forming apparatus 200 is opened and closed. FIGS. 4A and 4B are flow charts illustrating an example of a control procedure when the door of the image forming apparatus 200 is opened and closed. FIG. 3A is a timing chart of each configuration device in a case where the right door unit 111 is opened while the image forming apparatus is in an image forming operation. FIG. 4A indicates a control procedure at that time. FIG. 3B is a timing chart of each configuration device in a case where the right door unit 111 is closed. FIG. 4B indicates a control procedure at that time.

First, description is made using FIG. 3A and FIG. 4B with regard to the operation of the image forming apparatus 200 when the right door unit 111 is opened while the image forming apparatus 200 is in the image forming operation (before the image formation is completed).

Note that description is made by exemplifying a case where the door is opened at a timing of time t301 and then, the fixing unit 13 is removed at a timing of time t305 shown in FIG. 3A.

The CPU 205 decides whether or not the right door unit 111 is opened by the user, that is, decides whether or not the door is opened (S401). In particular, if the right unit door 111 is opened by the user while the image forming apparatus is in the image forming operation, the interlock switch SW2 is turned off. In accordance with this, the door open signal turns to low level at the timing of time t301 shown in FIG. 3A. This enables the CPU 205 to decide that the door is opened. If it is decided that the door is opened (S401: Yes), the CPU 205 instructs to stop the rotation of the fixing motor 204 which is in normal rotation. Also, power feeding to the heater of the fixing unit 13 is stopped. However, power supply to the fixing motor 204 is not stopped. Thereafter, at a timing of time t302 shown in FIG. 3A, the CPU 205 decides whether the recording material S exists at the fixing nip portion 13*b* or not.

Here, description is made with regard to deciding whether the recording material S exists at the fixing nip portion 13*b* or not. There may be a case where, after detection of the recording material S fed from the recording material storage 60 by the registration sensor 68, the recording material S is not detected by the delivery sensor 66 even when a predetermined time (a first predetermined time) elapses. In this case, the CPU 205 decides that the JAM, in which the recording material S is remaining at the fixing nip portion 13*b*, has occurred. Therefore, the CPU 205 stops the image forming operation of the image forming apparatus 200. In this way, the CPU 205, the registration sensor 68 and the delivery sensor 66 work as decision unit which decides whether the recording material S exists at the fixing nip portion 13*b* or not.

Also, there may be a case where, after detection of the recording material S by the delivery sensor 66, the delivery sensor 66 is not turned off even when a predetermined time (a second predetermined time) elapses. Even in this case, the CPU 205 decides that the JAM, due to which, the recording material S is remaining at the fixing nip portion 13*b*, is occurred at the fixing nip portion 13*b*.

Note that it can be configured so as to decide that the JAM, due to which, the recording material S is remaining at the fixing nip portion 13*b*, is occurred, in a case where, after detection of the recording material S by the registration sensor 68, the registration sensor 68 is not turned off even when the predetermined time elapses. In this way, through the use of the registration sensor 68 and the delivery sensor 66, it becomes possible to detect whether or not the recording material S exists at the fixing nip portion 13*b* even where the sensor is not directly provided to the fixing nip portion 13*b*. Also, the fact of whether or not each predetermined time has elapsed is detected by a timer (not shown).

If it is decided that the recording material S exists at the fixing nip portion 13*b* (S402: Yes), the CPU 205 decides whether or not the fixing nip portion 13*b* is in the pressurized state in accordance with the detection result of the pressure releasing sensor 69 (S403). If it is decided that the signal output from the pressure releasing sensor 69 is the signal indicating that the fixing nip portion 13*b* is in the pressurized state (ON signal) (S403: Yes), the CPU 205 instructs the fixing motor 204 to start reverse rotation, which starts separating operation at the fixing nip portion 13*b* (S404). Note that if it is decided that the recording material S does not exist at the fixing nip portion 13*b* at S402, the separating operation at the fixing nip portion 13*b* is not performed. Thereafter, the CPU 205 decides whether or not the signal output from the pressure releasing sensor 69 is the signal indicating that the fixing nip portion 13*b* is in the separating state (OFF signal) (S405).

If the output of the OFF signal is detected from the pressure releasing sensor 69 at a timing of time t303 shown in FIG. 3A (S405: Yes), the CPU 205 continues the reverse rotation at the fixing motor 204 during a period from the detection of the pressure release until a predetermined time t31 further elapses (S406). Note that, the predetermined time t31 [second] is a third predetermined time. The fact of whether or not the predetermined time has elapsed is detected by a timer (not shown). The CPU 205 instructs to stop the rotation of the fixing motor 204 at a timing of time t304 as shown in FIG. 3A to finish the separating operation at the fixing nip portion 13*b* (S407).

Note that it takes about one second from the start to the completion of the separating operation at the fixing nip portion 13*b*. This enables to complete the separating operation at the fixing nip portion 13*b* before the time t305 shown in FIG. 3A, which is the timing at which the user opens the right door unit 111 to remove the fixing unit 13. Also, after the detection of the OFF signal from the pressure releasing sensor 69, the CPU 205 further rotates the fixing motor 204 in the reverse direction for only the predetermined time t31 [second]. This enables to certainly separate the fixing nip portion 13*b*. As a result, the user can easily remove the recording material S from the conveyance path.

Next, description is made using FIG. 3B and FIG. 4B with regard to the operation of the image forming apparatus 200 in a case where the right door unit 111, opened by the user, is thereafter closed. Note that description is made on an assumption that the user closed the door at a timing of time t312 shown in FIG. 3B.

Based on the fixing device presence/absence signal as received, the CPU 205 decides whether the fixing device (fixing unit 13) is inserted into the image forming apparatus 200 or not. That is, the CPU 205 decides, based on the fixing device presence/absence signal as received, whether the fixing device is attached or not (S421). If it is decided that the fixing device is attached based on the fixing device presence/absence signal which turned "present" at time t311 shown in FIG. 3B (S421: Yes), the CPU 205 decides whether or not the door is closed by the user, i.e., decides whether or not the door is closed (S422). In particular, if the right unit door 111 is closed by the user, the interlock switch SW2 is turned on. In accordance with this, the door open signal is turned to high level at a timing of time t312 shown in FIG. 3B. This enables the CPU 205 to decide that the door is closed. If it is decided that the door is closed (S422: Yes), the CPU 205 decides whether or not the signal output from the pressure releasing sensor 69 is the signal indicating that the fixing nip portion 13*b* is in the separating state (OFF signal) (S423).

If the output of the OFF signal is detected from the pressure releasing sensor 69 (S423: Yes), the CPU 205 instructs the fixing motor 204 to start the normal rotation to start pressurizing operation at the fixing nip portion 13*b* (S424). Thereafter, the CPU 205 decides whether or not the signal output from the pressure releasing sensor 69 is the signal indicating that the fixing nip portion 13*b* is in the pressurized state (ON signal) (S425).

In a case where output of the ON signal is detected from the pressure releasing sensor 69 at a timing of time t313 shown in FIG. 3B (S425: Yes), the CPU 205 continues the normal rotation of the fixing motor 204 during a period from that timing until a predetermined time t32 [second] further elapses (S426). The CPU 205 instructs to stop the rotation of the fixing motor 204 at a timing of time t314 shown in FIG. 3B to finish the pressurizing operation of the fixing nip portion 13*b* (S427).

As mentioned above, the image forming apparatus 200 of the present invention detects the door opening while it is in the image forming operation. Also, when it is decided that the recording material S exists at the fixing nip portion 13*b*, the pressurized state of the fixing nip portion 13*b* is released (the fixing nip portion 13*b* is made into the separate state). This allows preventing the apparatus and the recording paper from being damaged when the user removes the recording paper from the conveyance path.

Also, the image forming apparatus 200 of the present embodiment completes the separating operation at the fixing nip portion 13*b* before the fixing unit 13 is removed by the user and power feeding to the fixing unit 13*b* is stopped. Therefore, the user can easily remove the recording paper S, and the use is prevented from the occurrence of accidents such as electrocution etc.

Note that the image forming apparatus 200 of the present embodiment conveys the recording material S and changes the fixing nip portion 13*b* into the pressurized state or the separating state through the use of the drive force of the fixing motor 204. Alternatively, a dedicated motor may be adapted to change, for example, the fixing nip portion 13*b* into the pressurized state or the separating state. In this case, the power supply of the dedicated motor is connected to the output of the interlock circuit 102.

Also, in the description of the present embodiment, description was made with regard to the operation example of the image forming apparatus 200 in a case where the right door unit 111 is opened and closed by the user. Other than the above, it can be configured such that the image forming apparatus 200 performs similar operation in a case whether the front door unit 112 is opened and closed by the user. In this configuration, it is possible to turn, even in a case whether the user opens the door during the image forming operation, the fixing nip portion 13*b* into the pressure releasing state (separating state). Therefore, operability in the JAM processing can further be enhanced. Further, it is possible to prevent the fixing unit 13 or the image forming apparatus 200 itself from being destroyed.

In addition, in the description of the present embodiment, description was made with regard to the operation example of the image forming apparatus 200 in a case where the door is opened during the image forming operation. However, even in a case where the door is opened after the image forming operation is stopped due to the jam of the recording material in the image forming operation, the image forming apparatus 200 may be configured to perform the similar operation as described above. In this case, even when the jam is occurred at the fixing nip portion, the fixing nip portion is turned to the pressure releasing state when the door is opened.

The above embodiments are only the examples to specifically explain the present invention. Therefore, the scope of the invention is not limited to these embodiments. For example, the present invention can be used as a printer, a copying machine, or a multifunction peripheral integrated these functions or other image forming apparatus.

While the present invention has been described with reference to exemplary embodiments, it is to be understood that the invention is not limited to the disclosed exemplary embodiments. The scope of the following claims is to be accorded the broadest interpretation as to encompass all such modifications and equivalent structures and functions.

This application claims the benefit of priority from Japanese Patent Application No. 2013-201879, filed Sep. 27, 2013, which is hereby incorporated by reference herein in its entirety.

What is claimed is:

1. An image forming apparatus comprising:

a conveyance path of a recording material provided in an inside of the image forming apparatus;

a door which is provided such that the inside of the apparatus including the conveyance path is exposed, a door opening/closing detection unit configured to detect opening or closing of the door;

a pair of rollers which forms a nip portion for holding and conveying the recording material on the conveyance path, a decision unit configured to decide whether or not the recording material exists at the nip portion; and a control unit configured to control a pressurized state and a pressure releasing state of the nip portion of the pair of rollers;

wherein the control unit is configured to control to release pressure at the nip portion in a case where the door opening is detected and the recording material exists at the nip portion.

2. The image forming apparatus according to claim 1, wherein the control unit is configured so as not to release pressure at the nip portion in a case where the door opening is detected and the recording material does not exist at the nip portion.

3. The image forming apparatus according to claim 2, further comprising a first sensor and a second sensor, the first sensor arranged on an upstream of the nip portion along the conveyance path of the recording material and adapted to detect presence or absence of the recording material at the arranged position, and the second sensor arranged on a downstream of the nip portion and adapted to detect presence or absence of the recording material at the arranged position;

wherein the decision unit is configured to decide that the recording material exists at the nip portion in a case where the recording material is not detected by the second sensor during a period after detection of the recording material by the first sensor and before a first predetermined time elapses or in a case where a second predetermined time has elapsed while the recording material is being detected by the first sensor or the second sensor.

4. The image forming apparatus according to claim 1, further comprising:

a motor configured to rotate in a first direction thereby causing the pair of rollers to rotate with its nip portion in a pressurized state and configured to rotate in a second direction, which is reverse to the first direction, thereby separating the pair of rollers; and a pressure releasing sensor configured to detect whether or not pressure at the nip portion is released, wherein the control unit is configured to rotate the motor in the second direction in a case where the door opening is detected and pressure is detected at the nip portion by the pressure releasing sensor.

5. The image forming apparatus according to claim 4, wherein the control unit rotates the motor in the second direction until a third predetermined time elapses from detection of release of the pressure at the pressure releasing sensor.

6. The image forming apparatus according to claim 5, wherein the control unit is configured to rotate the motor in the first direction in a case where the door closing is detected and release of the pressure is detected at the pressure releasing sensor.

7. The image forming apparatus according to claim 6, wherein the control unit rotates the motor in the first direction until a forth predetermined time elapses from detection of the pressure at the nip portion by the pressure release sensor.

8. The image forming apparatus according to claim 7, wherein the pair of rollers is formed in a unit which is capable of being removed from the image forming apparatus by opening the door; and wherein the control unit is configured to stop power supply to the motor in a case where the unit is removed from the image forming apparatus.

9. The image forming apparatus according to claim 8, wherein the control unit enables to supply power to the motor in a case where the unit is attached to the image forming apparatus.

10. The image forming apparatus according to any of claim 1 to claim 9, wherein the pair of rollers is a roller pair for fixing toner on the recording material by heat.

11. The image forming apparatus according to claim 1, wherein the pair of rollers is a fixing unit configured to fix toner on the recording material by heat; and wherein the control unit is configured to stop power supply to the fixing unit after releasing pressure at the nip portion.

* * * * *